US005124054A

United States Patent [19]

Habeeb et al.

[11] Patent Number: 5,124,054

[45] Date of Patent: * Jun. 23, 1992

[54] METHOD OF IMPROVING THE THERMAL STABILITY OF QUATERNARY AMMONIUM HYDROXIDES (PNE-539)

[75] Inventors: Jacob J. Habeeb, Westfield; Kenneth D. Rose, Clinton, both of N.J.

[73] Assignee: Exxon Research and Engineering Company, Florham Park, N.J.

[ * ] Notice: The portion of the term of this patent subsequent to Feb. 20, 2007 has been disclaimed.

[21] Appl. No.: 290,346

[22] Filed: Dec. 29, 1988

[51] Int. Cl.[5] ..... C10M 133/04

[52] U.S. Cl. ..... 252/32.5; 252/47.5; 252/50; 252/33.4; 252/56 R; 252/51.5 A; 252/32.7 R

[58] Field of Search ..... 252/34, 32.5, 32.7, 252/47.5, 33.4, 56 R, 51.5 A; 44/72

[56] References Cited

U.S. PATENT DOCUMENTS

| | | | |
|---|---|---|---|
| 2,911,368 | 11/1959 | Fowler et al. | 252/34 |
| 3,121,091 | 2/1964 | Green | 44/63 |
| 3,468,640 | 9/1969 | Barusch et al. | 44/72 |
| 3,778,371 | 12/1973 | Malec | 44/72 |
| 4,787,916 | 11/1988 | Feldman | 44/72 |
| 4,902,437 | 2/1990 | Vardi et al. | 252/34 |

*Primary Examiner*—Jaqueline V. Howard
*Attorney, Agent, or Firm*—John W. Ditsler

[57] ABSTRACT

The presence of a minor amount of an anti-oxidant, a metal detergent, a dispersant or mixtures thereof in a hydrocarbon liquid containing certain quaternary ammonium hydroxides has been found to be effective in improving the thermal stability of the hydroxides.

36 Claims, No Drawings

METHOD OF IMPROVING THE THERMAL STABILITY OF QUATERNARY AMMONIUM HYDROXIDES (PNE-539)

BACKGROUND OF THE INVENTION

1. Field of the Invention

This invention relates to a method for improving the thermal stability of quaternary ammonium hydroxides present in a hydrocarbon liquid by adding an antioxidant, a metal detergent, a dispersant, or mixtures thereof to the liquid.

2. Background of the Invention

Quaternary ammonium hydroxides have been added to fuels used in internal combustion engines (see U.S. Pat. No. 4,787,916 which discloses that adding a particular class of quaternary ammonium hydroxides to gasoline reduces the octane requirement increase, or ORI). Quaternary ammonium hydroxides have also been added to lubricating oils used in internal combustion engines to reduce ORI and combustion chamber deposits in spark ignition engines, and to reduce oil consumption in diesel engines (see copending patent application Ser. No. 290,401 filed on the same date herewith, now U.S. Pat. No. 4,902,437.

However quaternary ammonium hydroxides will decompose to their corresponding amines when exposed to temperatures above about 40° C. This temperature is readily obtained in an internal combustion engine and is not untypical of liquid storage or delivery systems. As such, the benefits of using these compounds in fuels or lubricating oils will be limited. Therefore, it would be desirable to have available a simple, yet convenient method to improve the thermal stability of quaternary ammonium hydroxides so that the benefits obtained from using these compounds in engine fuels and lubricating oils can be extended.

SUMMARY OF THE INVENTION

This invention relates to a method for improving the thermal stability of certain quaternary ammonium hydroxides that are present in a hydrocarbon liquid. More specifically, adding an antioxidant, a metal detergent, a dispersant, or mixtures thereof to a hydrocarbon fuel or lubricating oil containing certain quaternary ammonium hydroxides improves the thermal stability of the hydroxides. A more significant improvement in thermal stability is obtained when an antioxidant and a metal detergent are added to the fuel or oil. Tricaprylmethyl ammonium hydroxide (TCMAH) is a frequently used quaternary ammonium hydroxide.

DETAILED DESCRIPTION OF THE INVENTION

The particular quaternary ammonium hydroxides of this invention are selected from compounds having the general formula:

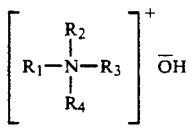

wherein $R_1$ is a hydrocarbon radical (or group) or a hydroxy terminated radical (or group) having from 1 to 24 carbon atoms, $R_2$ is a hydrocarbon radical having from 1 to 24 (preferably from 4 to 24) carbon atoms, and $R_3$ and $R_4$ are hydrocarbon radicals having from 4 to 24 carbon atoms. The hydrocarbon radicals ($R_1$, $R_2$, $R_3$, and $R_4$) can be alkyl groups, unsaturated paraffin groups, cyclic hydrocarbon groups, aryl groups, arylalkyl groups, or mixtures thereof. In addition, the groups can be normal, branched, substituted groups, or mixtures thereof. The hydrocarbon radicals may also contain other atoms such as nitrogen, oxygen, or sulfur; e.g., in the form of an alcohol, an amine, a ketone, a sulfide, a thiosulfide, and other functionalities.

Quaternary ammonium hydroxides in which the hydrocarbon radical is octyl, dodecyl, decyl, octadecyl, capryl radicals, or their mixtures are preferred. Preferred quaternary ammonium hydroxides are dimethyl dioctadecyl ammonium hydroxide, tetraoctyl ammonium hydroxide, tricaprylmethyl ammonium hydroxide, or mixtures thereof. Tetraoctyl ammonium hydroxide, tricaprylmethyl ammonium hydroxide, or mixtures thereof are especially preferred, with tricaprylmethyl ammonium hydroxide being most preferred.

The hydrocarbon liquid containing the quaternary ammonium hydroxide can vary broadly. For example, the hydrocarbon liquid could be a fuel (e.g. gasoline) or a lubricating oil that could be used in internal combustion engines (such as spark ignition or diesel engines). The liquid can be derived from natural hydrocarbons, synthetic hydrocarbons, or mixtures thereof.

The amount of quaternary ammonium hydroxide in the hydrocarbon liquid can vary broadly, but typically will range between about 0.001 to about 5 wt. %, although larger amounts could be present. However, the precise amount will depend on whether the hydrocarbon liquid is a fuel or a lubricating oil. Typically, between about 0.001 to about 0.075 wt. % of the quaternary ammonium hydroxides will be present in a fuel, although from about 0.003 to about 0.03 wt. % is more typical. From about 0.1 to about 5 wt. % or more of the quaternary ammonium hydroxides will be present in a lubricating oil, although from about 0.2 to about 2.0 wt. % is more typical.

The antioxidant used in this invention is a sulfurized alkyl phenol, a metal phosphate, an alkylated diphenyl amine, or mixtures thereof. Sulfurized alkyl phenols are derived from compounds containing at least one hydroxy group and at least one alkyl radical attached to the same aromatic ring. The alkyl radical ordinarily contains about 3 to 100, preferably about 6 to 20, carbon atoms. The alkyl phenol may contain more than one hydroxy group as exemplified by alkyl resorcinols, hydroquinones, and catechols, or it may contain more than one alkyl radical; but normally it contains only one of each. Compounds in which the alkyl and hydroxy groups are ortho, meta, and para to each other, and mixtures of such compounds, may be used. Illustrative alkyl phenols are n-propylphenol, isopropylphenol, n-butylphenol, t-butylphenol, hexylphenol, heptylphenol, octylphenol, nonylphenol, n-dodecylphenol, (propene tetramer)-substituted phenol, octadecylphenol, elcosylphenol, polybutene (molecular weight about 1000)-substituted phenol, n-dodecylresorcinol, and 2,4-di-t-butylphenol. Also included are methylene-bridged alkyl phenols of the type which may be prepared by the reaction of an alkyl phenol with formaldehyde or a formaldehyde-yielding reagent such as trioxane or paraformaldehyde.

The metal phosphate is preferably a metal selected from the group consisting of Group IB, IIB, VIB, VIII of the Periodic Table, and mixtures thereof. A metal dithiophosphate is a preferred metal phosphate, with a metal dialkyldithiophosphate being particularly preferred. Copper, nickel, zinc, or mixtures thereof are particularly preferred metals. The alkyl groups preferably comprise $C_3$ to $C_{10}$ alkyls. Particularly preferred compounds are zinc dialkyldithiophosphates.

The alkylated diphenyl amines used herein have the formula

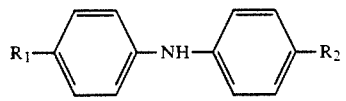

wherein $R_1$ and $R_2$ are alkyl groups containing from 1 to 20, preferably from 3-10, carbon atoms.

The metal detergents used herein are detergents containing a core of alkaline earth metal carbonates surrounded by a stabilizing surfactant such as alkyl benzene sulfonates (two alkyl groups of a total of at least 20 carbon atoms). These detergents can be either neutral or basic (see Gilbert, E. E., et. al., "Sulfonation with Sulfur Trioxide", Ind. and Eng. Chem., 50, p. 997-1000 (1958), the disclosure of which is incorporated herein by reference). Detergents may also include the broad class of metal phenates (neutral and basic) which also includes salts of alkyl phenols, alkyl phenol sulfides, and alkyl pheonol aldehyde products (see U.S. Pat. Nos. 2,228,661; 2,250,188; 2,360,302; 2,362,291; 2,375,222; 2,680,097; and 2,680,098, the disclosures of which are incorporated herein by reference). The alkyl groups on the phenol are olefins containing eight or more carbon atoms. In addition, detergents may be the salicylate ester, alkyl salicylate ester and sulfurized alkyl salicylate metal salts. The neutral and basic metal thiophosfonate salts are suitable detergents as well (see U.S. Pat. Nos. 2,377,955; 2,688,612; 2,759,920; 2,851,416; 2,875,188; and 2,906,709; the disclosures of which are incorporated herein by reference). Suitable metals are barium, calcium, magnesium, or sodium. Preferred metals are calcium and magnesium. Metal detergents based on calcium and magnesium are particularly preferred.

The dispersants used herein include (a) N-substituted long chain alkenyl succinimides (see U.S. Pat. Nos. 3,172,892 and 3,381,022), (b) high molecular weight esters and polyesters (see U.S. Pat. No. 3,381,022), (c) amine salts of high molecular weight organic acids, (d) Mannich base derived from high molecular weight alkylated phenols (see U.S. Pat. No. 3,634,515), (e) copolymers of methacrylates or acrylates containing polar groups such as amines, amides, imines, imides, hydroxyl, ether, etc (see Schilling, A., "Motor Oils and Engine Lubrication," Scientific Publications (T.B.) Ltd.)—the disclosures of each of these references being incorporated herein by reference. The preferred dispersants are the N-substituted long chain alkenyl succinimides such as those described in U.S. Pat. No. 3,381,022. This dispersant is made from the condensation of polyisobutylene (PIB), which has an average molecular weight in the range of 500 to 5000, with maleic anhydride and then reacted with polyalkylene amine (PAM). PAM could be polyethyl or propylene amine (e.g., triethylene tetramine, tetraethylene pentamine, and N-aminoalkylmorpholines) containing an average of 3-12 nitrogen atom per molecule. This dispersant could also be borated and used as a borated dispersant.

The amount of antioxidant, detergent, and dispersant added may vary broadly. Typically, however, the amount of each will range from about 0.001 to about 10 wt. % and preferably from about 0.1 to about 6 wt. %.

The quaternary ammonium hydroxides described hereinabove can be readily prepared from their corresponding commercially available quaternary ammonium salt, such as a halide. For example, a quaternary ammonium chloride may be contacted with an anion exchange resin such that the chloride is exchanged to produce the corresponding quaternary ammonium hydroxide.

Similarly the antioxidants, detergents, and dispersants used herein may be prepared by methods known to those skilled in the art and, as such, are readily obtained as articles of commerce.

In addition to the quaternary ammonium hydroxides, other additives known in the art may be present in the fuel or lubricating oil.

This invention may be further understood by reference to the following example which is not intended to restrict the scope of the claims appended hereto.

EXAMPLE

Carbon-13 NMR spectra were obtained for six samples using a Varian XL-300 NMR spectrometer operating at 75.4 MHz for the C13 nucleus. One sample contained only toluene, TCMAH, and isopropanol (IPA). The remaining five samples contained toluene, TCMAH, isopropanol, and various additives. Typical acquisition conditions of the spectra included a 5 second delay between acquisition pulses, a 45 degree observation RF pulse, and gated H1 decoupling. About 1 hour of data acquisition was used throughout.

For variable temperature experiments, TCMAH concentrate in isopropanol was diluted with toluene and placed in a screwtop 10mm NMR tube. Some deuterated toluene (or deuterated benzene) was also added to provide an internal magnetic field locking and shimming standard.

In an overnight unattended experiment, a spectrum was obtained at 30° C. on a freshly prepared solution of each sample. At the conclusion of data acquisition, the temperature was increased to 50° C. and held at this temperature for about 2 hours before data acquisition was started. Following acquisition of the 50° C. spectrum, the temperature was again increased to 75° C. and the 2 hour incubation, 1 hour accumulation repeated. This process was again repeated at 100° C. Shimming of the magnetic field was automatically conducted after each temperature adjustment.

Interpretation of the resulting spectra focussed on the carbon-13 resonances assigned to methyl and methylene carbons adjacent to the ammonium nitrogen. These signals appear in the C13 spectrum at 49.2 and 61.6 ppm, respectively. The methine carbon resonance of isopropanol (62.6 ppm) was used as an internal standard for integration against which changes in the integrals of assigned TCMAH resonances could be determined. The integral values measured at each temperature were converted to mole percent values based on the number of carbons associated with the TCMAH structure and were normalized to 100 moles of isopropanol solvent. The results of these tests are summarized in Table 1.

Table 1 also shows that the % decomposition and % improvement in thermal stability for each sample, which were calculated as follows:

$$\% \text{ decomposition} = \frac{\text{moles at } 30^\circ \text{ C.} - \text{moles at } 100^\circ \text{ C.}}{\text{moles at } 30^\circ \text{ C.}} \times 100$$

$$\% \text{ thermal stability improvement} = \frac{69 - \% \text{ decomposition of sample}}{69} \times 100$$

TABLE 1

| Sample Description | 30° C. | 50° C. | 75° C. | 100° C. | $C_{13}$-NMR Chemical Shift at 49.2 ppm % Decomposition | % Thermal Stability Improvement |
|---|---|---|---|---|---|---|
| | Moles Relative to IPA | | | | | |
| 1. Toluene + TCMAH + IPA (1.03 g) (0.5005 g) (0.5005 g) | 17 | 14.9 | 8.3 | 5.2 | 69 | — |
| 2. Toluene + TCMAH + IPA + Dispersant (1) (1.05 g) (0.503 g) (0.503 g) (0.18 g) | 18.2 | 16.3 | 10.3 | 6.7 | 63 | 9 |
| 3. Toluene + TCMAH + IPA + Mg sulfonate (1.02 g) (0.503 g) (0.503 g) (0.16 g) | 16.3 | 15.4 | 14.1 | 13.1 (2) | 20 (3) | 71 (3) |
| 4. Toluene + TCMAH + IPA + ZDDP (0.97 g) (0.503 g) (0.503 g) (0.19 g) | 12.3 | 11.4 | 10.6 | 9.3 | 24 | 65 |
| 5. Toluene + TCMAH + IPA + nonyl phenol sulfide (0.23 g) (1.01 g) (0.503 g) (0.503 g) | 13.7 | 12.5 | 11.5 | 9.1 | 34 | 51 |
| 6. Toluene + TCMAH + IPA + Mg Sulfonate + ZDDP + (nonyl phenol sulfide (1.1 g) (0.5 g) (0.5 g) (0.2 g) (0.12 g) (0.26 g) | 16.7 | 17.0 | 15.9 | 16.1 | 4 | 94 |

(1) The dispersant was polyisobutylene succinic acid polyalkylene amine.
(2) Extrapoliated from 30° C., 50° C., and 75° C. data.
(3) Based on extrapolation in (2).

The data in Table 1 show that an antioxidant a metal detergent, or a dispersant is effective in improving the thermal stability of quaternary ammonium hydroxides in a hydrocarbon liquid. The data also show that the greatest improvement in thermal stability is obtained when the antioxidant and metal detergent are both present.

What is claimed is:

1. A method for improving the thermal stability of a quaternary ammonium hydroxide in a lubricating oil, wherein the quaternary ammonium hydroxide has the general formula:

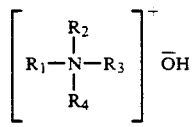

where $R_1$ is a hydrocarbon radical or a hydroxy terminated radical having from 1 to 24 carbon atoms, $R_2$ is a hydrocarbon radical having from 1 to 24 carbon atoms wherein R, $R_2$, $R_3$, and $R_4$ optionally contain nitrogen, oxygen or sulfur atoms and $R_3$ and $R_4$ are hydrocarbon radicals having from 4 to 24 carbon atoms, which comprises contacting the hydroxide in the lubricating oil with an antioxidant, a metal detergent, a dispersant, or mixtures thereof.

2. The method of claim 1 wherein the antioxidant is a sulfurized alkyl phenol, a metal phosphate, an alkylated diphenyl amine, or mixtures thereof.

3. The method of claim 2 wherein the metal detergent comprises at least one member selected from the group consisting of a metal sulfonate, a metal phenate, sulfurized alkyl salicylate metal salts, metal thiophosfonates, or mixtures thereof, wherein the metal is Ba, Ca, Mg, Na, or mixtures thereof.

4. The method of claim 3 wherein the dispersant comprises at least one member selected from the group consisting of esters, polyesters, amine salts of high molecular weight organic acids, Mannich base derived from high molecular weight alkylated phenols, N-substituted long chain alkenyl succinimides, or mixtures thereof.

5. The method of claim 1 wherein $R_2$ has from 4 to 24 carbon atoms.

6. The method of claim 1 wherein the quaternary ammonium hydroxide is present in an amount ranging from about 0.1 to about 5 wt. %.

7. The method of claim 1 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

8. The method of claim 7 wherein $R_1$, $R_2$, $R_3$, $R_4$, or mixtures thereof is selected from the group consisting of octyl, dodecyl, decyl, octadecyl, capryl radicals, and mixtures thereof.

9. The method of claim 8 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

10. The method of claim 9 wherein the quaternary ammonium hydroxide comprises tricaprylmethyl ammonium hydroxide.

11. A method for improving the thermal stability of a quaternary ammonium hydroxide in a lubricating oil for an internal combustion engine, wherein the quaternary ammonium hydroxide has the general formula:

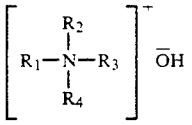

where $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, which comprises contacting the quaternary ammonium hydroxide with a sulfurized alkyl phenol, zinc dialkyldithiophosphate, a metal detergent, a dispersant, or mixtures thereof.

12. The method of claim 11 wherein the sulfurized alkyl phenol, the zinc dialkyldithiophosphate, the metal detergent, and the dispersant are each present in the lubricating oil in an amount ranging from about 0.001 to about 10 wt. %.

13. The method of claim 12 wherein the metal detergent comprises at least one member selected from the group consisting of a metal sulfonate, a metal phenate, sulfurized alkyl salicylate metal salts, metal thiophosfonates, or mixtures thereof, wherein the metal is Ba, Ca, Mg, Na, or mixtures thereof.

14. The method of claim 13 wherein the dispersant comprises at least one member selected from the group consisting of esters, polyesters, amine salts of high molecular weight organic acids, Mannich base derived from high molecular weight alkylated phenols, N-substituted long chain alkenyl succinimides.

15. The method of claim 11 wherein $R_2$ has from 4 to 24 carbon atoms.

16. The method of claim 11 wherein the quaternary ammonium hydroxide is present in an amount ranging from about 0.1 to about 5 wt. %.

17. The method of claim 11 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

18. The method of claim 17 wherein $R_1$, $R_2$, $R_3$, $R_4$, or mixtures thereof is selected from the group consisting of octyl, dodecyl, decyl, octadecyl, capryl radicals, and mixtures thereof.

19. The method of claim 18 wherein the quaternary ammonium hydroxide is selected from the group consisting of dimethyl dioctadecyl quaternary ammonium hydroxide, tetraoctyl ammonium hydroxide, tricaprylmethyl ammonium hydroxide, and mixtures thereof.

20. The method of claim 19 wherein the quaternary ammonium hydroxide comprises tricaprylmethyl ammonium hydroxide.

21. The method of claim 11 wherein $R_1$, $R_2$, $R_3$, $R_4$, or mixtures thereof contains a nitrogen atom, an oxygen atom, a sulfur atom, or mixtures thereof.

22. The methods of claim 1 wherein the antioxidant, the metal detergent, and the dispersant are each present in the lubricating oil in an amount ranging from about 0.001 to about 10 wt. %.

23. The method of claim 12 wherein each are present in an amount ranging from about 0.1 to about 6 wt. %.

24. The method of claim 11 wherein the metal detergent comprises a metal sulfonate in which the metal is Ba, Ca, Mg, or Na.

25. The method of claim 24 wherein the metal in the metal detergent is Ca or Mg.

26. The method of claim 24 wherein the dispersant comprises a N-substituted long chain alkenyl succinimide.

27. The method of claim 25 wherein the dispersant comprises polyisobutylene succinic acid polyalkylene amine.

28. The method of claim 27 wherein the quaternary ammonium hydroxide is present in an amount ranging from about 0.1 to about 5 wt. %.

29. A method for improving the thermal stability of a quaternary ammonium hydroxide in lubricating oil for an internal combustion engine, wherein the quaternary ammonium hydroxide is selected from the group consisting of dimethyl dioctadecyl ammonium hydroxide, tetraoctyl ammonium hydroxide, tricaprylmethyl ammonium hydroxide, or mixtures thereof, which comprises contacting the quaternary ammonium hydroxide with (a) from about 0.1 to about 6 wt. % of an antioxidant selected from the group consisting of a sulfurized alkyl phenol, a metal phosphate, an alkylated diphenyl amine, and mixtures thereof, (b) from about 0.1 to about 6 wt. % of a metal detergent comprising at least one member selected from the group consisting of a metal sulfonate, a metal phenate, sulfurized alkyl salicylate metal salts, metal thiophosfonates, or mixtures thereof, wherein the metal is Ba, Ca, Mg, or Na, (c) from about 0.1 to about 6 wt. % of a dispersant comprising at least one member selected from the group consisting of esters, polyesters, amine salts of high molecular weight organic acids, Mannich base derived from high molecular weight alkylated phenols, N-substituted long chain alkenyl succinimides, or mixtures thereof; of (d) mixtures thereof.

30. The method of claim 29 wherein the quaternary ammonium hydroxide comprises tricaprylmethyl ammonium hydroxide.

31. The method of claim 29 wherein the antioxidant comprises a sulfurized alkyl phenol.

32. The method of claim 31 wherein the sulfurized alkyl phenol comprises nonyl phenol sulfide.

33. The method of claim 29 wherein the metal detergent comprises a metal sulfonate.

34. The method of claim 33 wherein the metal in the metal detergent is Ca or Mg.

35. The method of claim 34 wherein the dispersant comprises a N-substituted long chain alkenyl succinimide.

36. The method of claim 35 wherein the dispersant comprises polyisobutylene succinic acid polyalkylene amine.

* * * * *